US008018401B2

(12) United States Patent
Shin

(10) Patent No.: US 8,018,401 B2
(45) Date of Patent: Sep. 13, 2011

(54) ORGANIC ELECTROLUMINESCENT DISPLAY AND DEMULTIPLEXER

(75) Inventor: Dong-Yong Shin, Seoul (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 1878 days.

(21) Appl. No.: 11/134,383

(22) Filed: May 23, 2005

(65) Prior Publication Data

US 2005/0270257 A1 Dec. 8, 2005

(30) Foreign Application Priority Data

Jun. 2, 2004 (KR) ..... 10-2004-0039887

(51) Int. Cl.
*G09G 3/30* (2006.01)

(52) U.S. Cl. ..... 345/76; 345/45; 345/77; 345/83; 345/89; 345/98; 315/169.1; 315/169.3

(58) Field of Classification Search ..... 345/76–82, 345/87–103, 204–205, 208–210, 45.69; 315/169.1–169.3

See application file for complete search history.

(56) References Cited

U.S. PATENT DOCUMENTS

| | | | | |
|---|---|---|---|---|
| 5,781,167 | A | 7/1998 | Rebeschi et al. | |
| 5,852,425 | A | 12/1998 | Bird et al. | |
| 6,333,729 | B1 | 12/2001 | Ha | |
| 6,369,786 | B1 * | 4/2002 | Suzuki | 345/77 |
| 6,787,249 | B2 | 9/2004 | Seo | |
| 7,057,589 | B2 * | 6/2006 | Shin et al. | 345/82 |
| 7,180,497 | B2 * | 2/2007 | Lee et al. | 345/98 |
| 7,259,740 | B2 * | 8/2007 | Haga et al. | 345/98 |
| 7,342,559 | B2 * | 3/2008 | Shin | 345/76 |
| 7,501,999 | B2 * | 3/2009 | Shin | 345/76 |
| 2003/0107537 | A1 | 6/2003 | Ochi et al. | |
| 2003/0179164 | A1 | 9/2003 | Shin et al. | |

(Continued)

FOREIGN PATENT DOCUMENTS

CN 1432989 A 7/2003

(Continued)

OTHER PUBLICATIONS

Patent Gazette issued in Applicant's corresponding Chinese Patent Application No. 200510081760.0 dated Nov. 12, 2008.

(Continued)

*Primary Examiner* — Quan-Zhen Wang
*Assistant Examiner* — Jennifer Nguyen
(74) *Attorney, Agent, or Firm* — Robert E. Bushnell, Esq.

(57) ABSTRACT

An organic electroluminescent display and a demultiplexer, wherein the organic electroluminescent display comprises: a plurality of pixels including a plurality of sub-pixels and displaying images corresponding to a first data current; a plurality of scan lines transmitting a scan signal to the plurality of pixels; a plurality of first data lines transmitting the first data current to the plurality of pixels; a scan driver outputting the scan signal to the plurality of scan lines; a demultiplexer comprising a plurality of sample-and-hold demultiplexing circuits; and a data driver outputting a second data current to a plurality of second data lines, wherein the demultiplexing circuit transmits the first data current, obtained by demultiplexing the second data current in sample/hold method, to the first data lines, wherein a pre-charge voltage corresponding to the second data current is previously transmitted to the first data lines before the first data current is transmitted to the first data lines.

20 Claims, 9 Drawing Sheets

U.S. PATENT DOCUMENTS

| | | | | |
|---|---|---|---|---|
| 2005/0259052 | A1* | 11/2005 | Shin | 345/77 |
| 2005/0264495 | A1* | 12/2005 | Shin | 345/76 |

FOREIGN PATENT DOCUMENTS

| | | | |
|---|---|---|---|
| CN | 1447302 | A | 10/2003 |
| JP | 2003-058108 | | 2/2003 |
| JP | 2003-066908 | | 3/2003 |
| JP | 2003-114645 | | 4/2003 |
| JP | 2003-177709 | | 6/2003 |
| JP | 2003-177722 | | 6/2003 |
| JP | 2003-195815 | | 7/2003 |
| JP | 2004-029528 | | 1/2004 |
| JP | 2004-029755 | | 1/2004 |
| JP | 2005-338817 | | 12/2005 |
| WO | WO 03/038797 | | 5/2003 |

OTHER PUBLICATIONS

Office Action from the JPO issued in Applicant's corresponding Japanese Patent Application No. 2005-151308 dated May 27, 2008.

Office Action from The Patent Office of the People's Republic of China issued on Jul. 27, 2007 corresponding to Chinese Patent Application No. 200510081760.0.

* cited by examiner

ORGANIC ELECTROLUMINESCENT DISPLAY AND DEMULTIPLEXER

CROSS-REFERENCE TO RELATED APPLICATIONS

This application makes reference to, incorporates the same herein, and claims all benefits accruing under 35 U.S.C §119 from an application entitled Organic Electroluminescent Display And Demultiplexer earlier filed in the Korean Industrial Property Office on Jun. 2, 2004, and there duly assigned Korean Patent Application No. 2004-39887, by that office.

BACKGROUND

1. Field of the Invention

The present invention relates to an organic electroluminescent display and a demultiplexer, and more particularly, to an organic electroluminescent display comprising a demultiplexer having a plurality of demultiplexing circuits including a sample/hold circuit and a pre-charge switch.

2. Discussion of Related Art

An organic electroluminescent display uses the phenomenon of light of a particular wavelength emitted from excitons. Electrons and holes are injected through the cathode and anode of an organic thin-film and they recombine to form excitons. One of the features of an electroluminescent display is that it does not require extra sources of light, as opposed to the case with LCDs (liquid crystal display), because an organic electroluminescent display has self-emissive elements. Another feature for an organic electroluminescent display is that brightness of an organic electroluminescent device of an electroluminescent display is controlled by the amount of current flowing through the organic electroluminescent device.

There is a passive matrix method and an active matrix method in driving organic electroluminescent displays. In the passive matrix method, the anode and cathode are formed to cross at right angles and a line is selected to drive organic electroluminescent displays. While the advantages of an organic electroluminescent display driven by the passive matrix method include simple structure and relatively easy implementation, the problems with large screen implementations are high-energy consumption and decreased driving time for each emissive element. In the active matrix method, the amount of current flowing in an emissive element is controlled by using active elements. For an active element, a thin film transistor (labeled as "TFT" hereafter) is frequently used. The active matrix method is somewhat complex, but its advantages include low-energy consumption and prolonged light emission time (illumination period).

U.S. Pat. No. 6,787,249 to Satoshi Seo and titled ORGANIC LIGHT EMITTING ELEMENT AND LIGHT EMITTING DEVICE USING THE SAME, and incorporated herein, discusses organic light emitting elements that are bright and have low electric power consumption, and an organic light emitting device using the organic light emitting elements. Organic light emitting elements capable of converting triplet state excitation energy into light emission are manufactured by applying a binuclear complex having triplet excitation state electrons to the organic light emitting elements.

U.S. Pat. No. 5,852,425 to Neil Christopher Bird et al. and titled ACTIVE MATRIX DISPLAY DEVICES FOR DIGITAL VIDEO SIGNALS AND METHOD FOR DRIVING SUCH, and incorporated herein, discusses the use of sample-and-hold circuits following a demultiplexing of a data signal by demultiplexer when applying data to an active matrix display.

U.S. Pat. No. 5,781,167 to Thomas J. Rebeshi et al. and titled ANALOG VIDEO INPUT FLAT PANEL DISPLAY INTERFACE, and incorporated by reference, discusses the use of sample-and-hold circuits following a demultiplexing of a data signal by demultiplexer when applying data to a matrix display, such as an electroluminescent display panel.

SUMMARY OF THE INVENTION

It is an aspect of the present invention provide an organic electroluminescent display and a demultiplexer used by the organic electroluminescent display, comprising a demultiplexer including a demultiplexing circuit having pre-charge functions, driven by a sample/hold method, and located between a data driver and an organic electroluminescent display panel.

The foregoing and/or other aspects of the present invention are achieved by providing an organic electroluminescent display, comprising: a plurality of pixels including a plurality of sub-pixels and displaying images corresponding to a first data current; a plurality of scan lines transmitting a scan signal to the plurality of pixels; a plurality of first data lines transmitting the first data current to the plurality of pixels; a scan driver outputting the scan signal to the plurality of scan lines; a demultiplexer comprising a plurality of demultiplexing circuits; and a data driver outputting a second data current to a plurality of second data lines, wherein the demultiplexing circuit transmits the first data current, obtained by demultiplexing the second data current transmitted to one second data line in a sample/hold method, to the first data lines, wherein a pre-charge voltage corresponding to the first data current of each first data line is previously transmitted to the first data line before the first data current is transmitted to the first data lines.

Still another aspect of the present invention is achieved by providing a demultiplexer comprising: a plurality of demultiplexing circuits; a plurality of sample signal lines transmitting a sample signal to the demultiplexing circuit; first and second hold signal lines transmitting a hold signal to the demultiplexing circuit; and first and second pre-charge signal lines transmitting a pre-charge signal to the demultiplexing circuit, wherein the demultiplexing circuit transmits the first data current, obtained by demultiplexing the second data current transmitted to one second data line in a sample/hold method in response to the sample and hold signals, to a plurality of first data lines, wherein a pre-charge voltage corresponding to the first data current of each first data line is previously transmitted to the first data line before the first data current is transmitted to the plurality of first data lines.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

Figure 1:
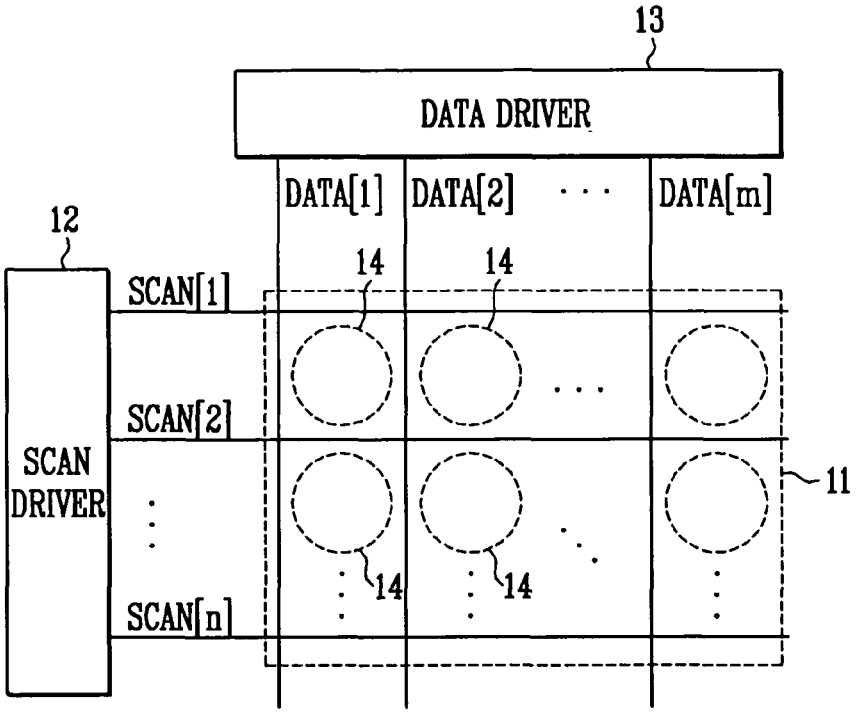
FIG. 1 (PRIOR ART)
FIG. 1 is a plan view of an organic electroluminescent display of size n×m by the active matrix method of related art.
Figure 2:
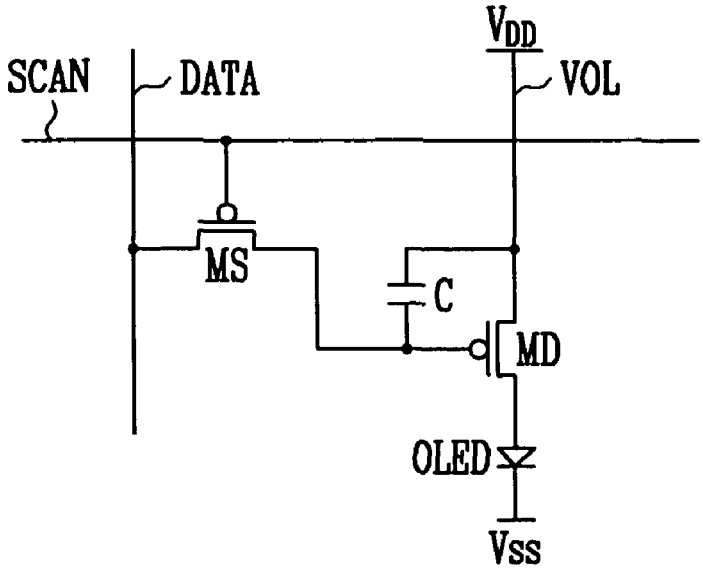
FIG. 2 (PRIOR ART)
FIG. 2 is a circuit diagram of a pixel adopted for the organic electroluminescent display in FIG. 1.

Referring to FIGS. 1 and 2, the organic electroluminescent display of the related art will be described.

FIG. 1 shows the organic electroluminescent display by the related art, of size n×m, driven by the active matrix method.

Referring to FIG. 1, the organic electroluminescent display includes an organic electroluminescent display panel 11, a scan driver 12, and a data driver 13. The organic electroluminescent display panel 11 includes n×m pixels 14, n scan lines that are horizontally arranged (SCAN[1], SCAN[2], . . . SCAN[n]) and m data lines that are vertically arranged (DATA[1], DATA[2], . . . DATA[m]). The scan line SCAN[1] transmits a scan signal to the pixels 14. Data lines DATA transmit data current to the pixels 14. The scan driver 12 applies scan signals to scan lines SCAN. The data driver 13 applies data current to the data lines DATA.

FIG. 2 is a circuit diagram of the pixel adopted for the organic electroluminescent display shown in FIG. 1.

Referring to FIG. 2, the pixel of an organic electroluminescent display comprises: an organic electroluminescent device (organic light emitting device: OLED), a driving transistor MD, a capacitor C, and a switching transistor MS. The driving transistor MD is connected to the organic electroluminescent device OLED and supplies current needed for illumination to the organic electroluminescent device OLED. The amount of current of the driving transistor MD is controlled by data voltage applied through the switching transistor MS. The capacitor C is connected between a source and a gate of the driving transistor MD and, for a certain period, maintains the voltage applied by the data voltage.

With this configuration, when the scan signal which is applied to the gate of the switching transistor MS turns on the switching transistor MS, the data voltage is applied to the gate of the driving transistor MD through the data line. And corresponding to the data voltage applied to the gate of the driving transistor MD, current flows into the organic electroluminescent device OLED through the driving transistor MD to emit light.

Here, the current flowing through the organic electroluminescent device OLED is calculated as in the equation 1.

$$I_{OLED}=I_D=(\beta/2)(V_{GS}-V_{TH})^2=(\beta/2)(V_{DD}-V_{DATA}-|V_{TH}|)^2 \quad \text{Equation 1}$$

Where $I_{OLED}$ is a current flowing in the organic electroluminescent device OLED; $I_D$ is a current flowing from the source to a drain of the driving transistor MD; $V_{GS}$ is a voltage applied between the gate and the source of the driving transistor MD; $V_{TH}$ is a threshold voltage of the driving transistor MD; $V_{DD}$ is a power voltage; $V_{DATA}$ is a data voltage; and β is a gain factor.

In the organic electroluminescent display by the related art, the data driver 13 is directly connected to the data lines DATA of the pixels 14. Therefore, the data driver 13 is complicated in proportion to the number of the data lines DATA. For example, the data driver 13 is realized as a chip separated from the organic electroluminescent display panel 11, the number of pins provided in the data driver 13 and the number of wirings connecting the data driver 13 with the organic electroluminescent display panel 11 are increased in proportion to the number of the data lines DATA, thereby increasing production cost and occupying much space.

Further, depending on the data inputted into the pixels, a current driving method is divided into a voltage programming method and a current programming method. Between the two, assuming that the current source supplying current to the pixel circuit is uniform throughout the whole panel, the pixel circuit of the current programming method has an advantage of achieving a uniform display despite the fact that the driving transistor in each pixel has the characteristic of irregular voltage-current.

However, in the pixel circuit of the current programming method, where the input data signal of the pixels is a current, the data programming time is influenced by the voltage state charged to the parasitic capacitance of the data lines DATA by the data current of the previous pixel line. As a result, the problem of slowing down of the data programming speed occurs, especially in low gradation.

Below, referring to FIGS. 3 through 9, the organic electroluminescent display according to embodiments of the present invention is explained. Hereinbelow, the concept of the present invention will be described mainly on the organic electroluminescent display optimally applied, but it is not confined in this only, but can be applied in all display devices including the pixel circuit of current programming method.

Figure 3:
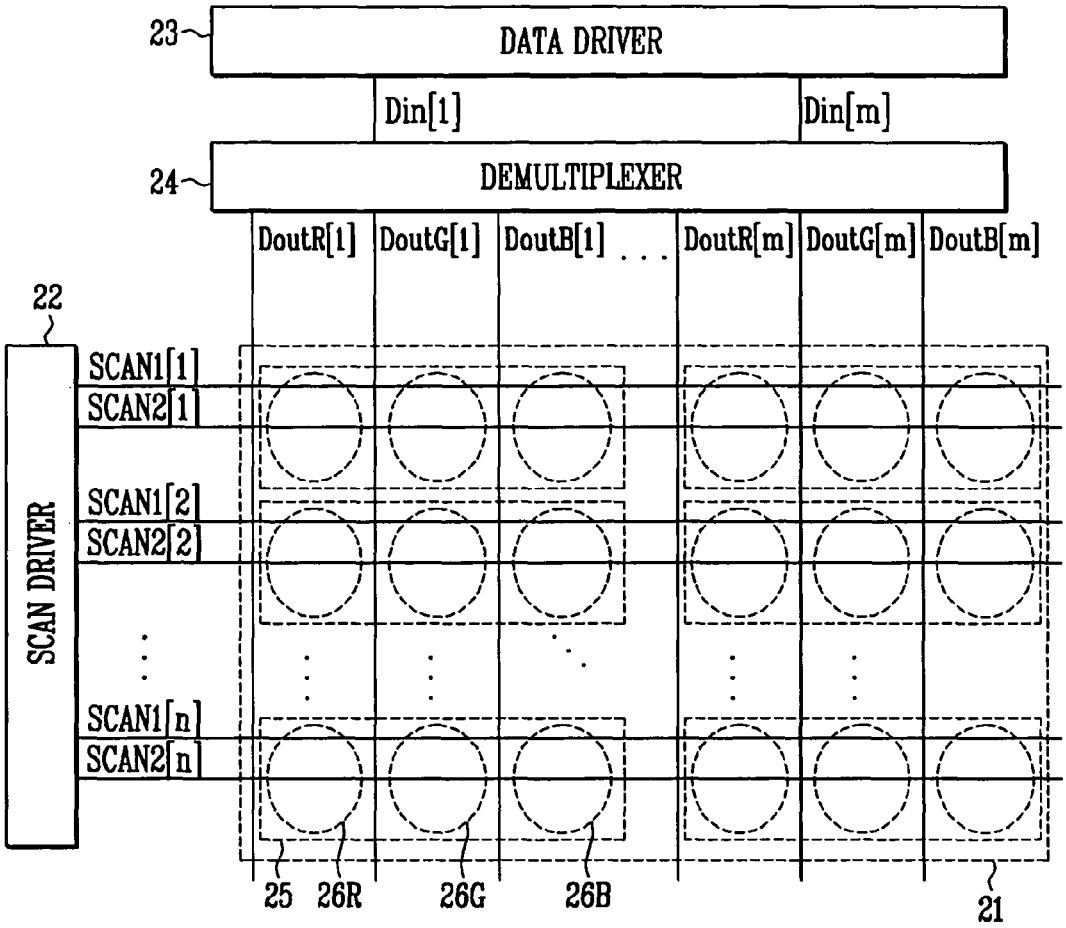
FIG. 3 is a circuit diagram of the organic electroluminescent display of size n×m by the active matrix method according to an embodiment of the present invention.

FIG. 3 is the circuit diagram of the organic electroluminescent display of an embodiment of the present invention by n×m active matrix method.

Referring to FIG. 3, the organic electroluminescent display comprises an organic electroluminescent display panel 21, scan driver 22, data driver 23 and a demultiplexer 24.

The organic electroluminescent display panel 21 comprises n×m pixels 25, n first scan lines SCAN1[1], SCAN1[2], . . . SCAN1[*n*] and n second scan lines SCAN2[1], SCAN2[2], . . . SCAN2[*n*] arranged horizontally, and 3m output data lines DoutR[1], DoutG[1], DoutB[1], . . . DoutR[m], DoutG[m], DoutB[m] arranged vertically. Each pixel 25 is the smallest unit that can express color of choice, comprising the sub-pixel 26R that emits red color, the sub-pixel 26G that emits green color and the sub-pixel 26B that emits blue color.

The first and second scan lines SCAN1 and SCAN2 transmit the first and second scan signals to the pixel 25. The output data line of red color DoutR, the output data line of green color DoutG, and the output data line of blue color DoutB, transmit the output data current to the sub-pixel of red color 26R, the sub-pixel of green color 26G, and the sub-pixel of blue color 26B, respectively. The sub-pixels 26R, 26G, and 26B are driven by the current programming method, or more specifically, the voltage corresponding to the current flowing through output data lines DoutR, DoutG, and DoutB for a selection period is recorded in corresponding capacitors (not shown), and while light is being emitted, the current corresponding to the voltage of the capacitor is supplied to the organic electroluminescent device.

The scan driver 22 applies the first and second scan signals to the first scan line SCAN1 and the second scan line SCAN2.

Data driver 23 transmits the input data current to m input data lines Din[1], Din[2], . . . Din[m]. Here, m is an integer whose value is 1.5n. The data driver 23 comprises a voltage pre-charge part (not shown), and in this case, the pre-charge voltage is transmitted to m input data lines Din[1], Din[2], . . . Din[m].

Demultiplexer 24 receives the input data current and transmits demultiplexed output data current and pre-charge voltage to 3m output data lines DoutR[1], DoutG[1], DoutB[1], . . . DoutR[m], DoutG[m], DoutB[m]. The demultiplexer 24 includes sample/hold circuits (not shown). Each demultiplexing circuit is, for example, a 1:2 demultiplexing circuit, and therefore the input data current transmitted to one input data line Din is demultiplexed to 2 output data lines. Before the output data current is transmitted to the output data lines, the pre-charge voltage is applied.

Figure 4:
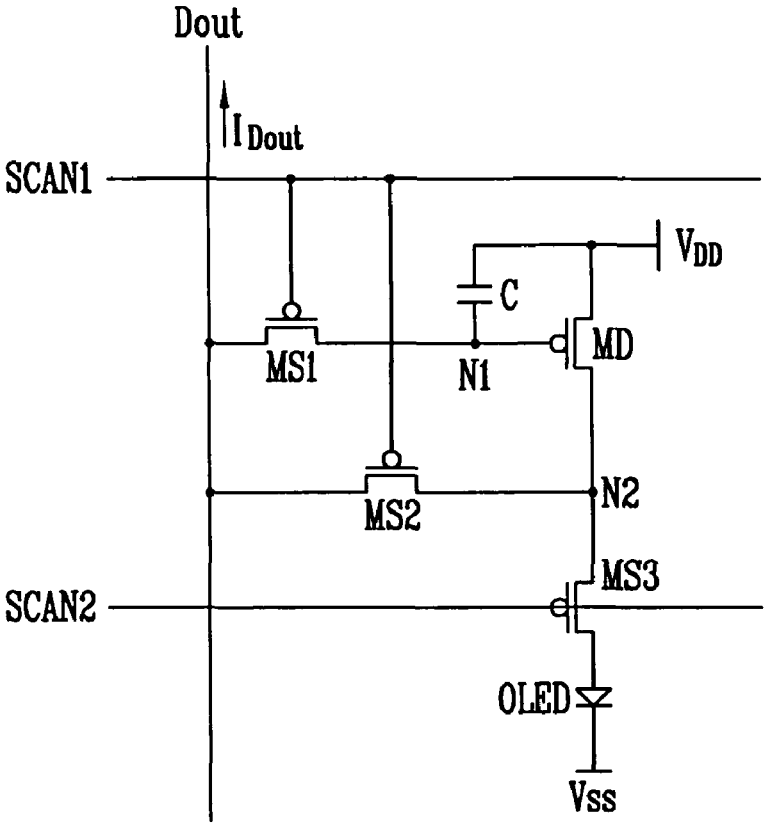
FIG. 4 is a circuit diagram of a pixel adopted for the organic electroluminescent display in FIG. 3.

FIG. 4 is a circuit diagram of a sub-pixel adopted to the organic electroluminescent display in FIG. 3.

Referring to FIG. 4, the sub-pixel comprises the organic electroluminescent device OLED and a sub-pixel circuit. The sub-pixel circuit comprises a driving transistor MD, a first switching transistor MS1, a second switching transistor MS2, a third switching transistors MS3, and a capacitor C. The driving transistor MD and the first through third switching transistors MS1, MS2, MS3 each includes a gate, a source and a drain. The capacitor C includes a first terminal and a second terminal.

The gate of the first switching transistor MS1 is connected to first scan line SCAN1, the source is connected to a first node N1, and the drain is connected to output data line Dout, which is one of the red output data line, green output data line or blue output data line in FIG. 3. The first switching transistor MS1 responds to the first scan signal applied to the first scan line SCAN1 and performs the function of charging electric charge to the capacitor C.

The gate of the second switching transistor MS2 is connected to first scan line SCAN1, the source is connected to a second node N2 and the drain is connected to output data line Dout. The second switching transistor MS2, in response to the first scan signal that is applied to the first scan line SCAN1, performs the function of transmitting the output data current IDout to the driving transistor MD.

The gate of the third switching transistor MS3 is connected to second scan line SCAN2, the source is connected to second node N2, and the drain is connected to the organic electroluminescent device OLED. The third switching transistor MS3, in response to the second scan signal that is applied to the second scan line SCAN2, performs the function of transmitting the current flowing through the driving transistor MD to the organic electroluminescent device OLED.

A power voltage $V_{DD}$ is applied to the first terminal of the capacitor C, and the second terminal is connected to the first node N1. While the first and second switching transistors MS1 and MS2 are turned on, the capacitor C charges the quantity of electric charge related to the voltage $V_{GS}$ between the gate and the source corresponding to the output data current $I_{Dout}$ flowing in the driving transistor MD, and while the first and second switching transistors MS1 and MS2 are turned off, the capacitor C performs the function of maintaining the voltage.

The gate of the driving transistor MD is connected to the first node N1, the power voltage is applied to the source $V_{DD}$, and the drain is connected to the second node N2. While the third switching transistor MS3 is on, the driving transistor MD supplies the current corresponding to the current between the first terminal and second terminal of the capacitor to the organic electroluminescent display OLED.

Figure 5:
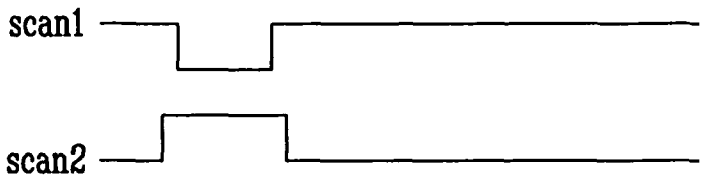
FIG. 5 is a signal diagram as time elapsed in driving the pixel circuit in FIG. 4.

FIG. 5 is a signal diagram for driving the sub-pixel circuit in FIG. 4 as time passes. In FIG. 5, the first scan signal scan1 and the second scan signal scan2 are described.

Referring to FIGS. 4 and 5, during a selection period where the first scan signal scan1 is low and the second scan signal scan2 is high, the first switching transistor MS1 and the second switching transistor MS2 are turned on and the third switching transistor MS3 is turned off. And it is during this period that the output data current $I_{Dout}$ flowing through the output data line Dout is transmitted to the driving transistor MD. Equation 2 determines the voltage $V_{GS}$ between the gate and source of the driving transistor MD, and the electric charge corresponding to the voltage $V_{GS}$ between the gate and the source is charged to the capacitor C.

$$I_D = I_{Dout} = (\beta/2)(V_{GS} - V_{TH})2 \quad \text{Equation 2}$$

During the light emission period where the first scan signal scan1 is high and the second scan signal scan2 is low, the third switching transistor MS3 is turned on and the first switching transistor MS1 and the second switching transistor MS2 are turned off. Since the electric charge charged to the capacitor C during a selection period is maintained throughout the light emission period, the voltage between the first terminal and the second terminal of the capacitor C that was determined during the selection period, or the voltage between the gate and source of the driving transistor MD is maintained throughout the light emission period. The current $I_D$ flowing through the driving transistor MD is, as shown in the equation 2, determined by the voltage $V_{GS}$ between the gate and the source, the output data current $I_{Dout}$ that flows through the driving transistor during the selection period also flows through the driving transistor MD during the light emission period as well. Consequently, the current $I_{OLED}$ flowing through the organic electroluminescent device OLED is as shown in the equation 3.

$$I_{OLED} I_D = I_{Dout} \quad \text{Equation 3}$$

As shown in Equation 3, since the current $I_{OLED}$ flowing through the organic electroluminescent device OLED of the sub-pixels described in FIG. 4 is equal to the output data current $I_{Dout}$, and the current $I_{OLED}$ flowing through the organic electroluminescent device OLED is not influenced by the threshold voltage of the driving transistor. In other words, using the sub-pixel circuit prevents the influence of the threshold voltage of the driving transistor MD.

Figure 6:
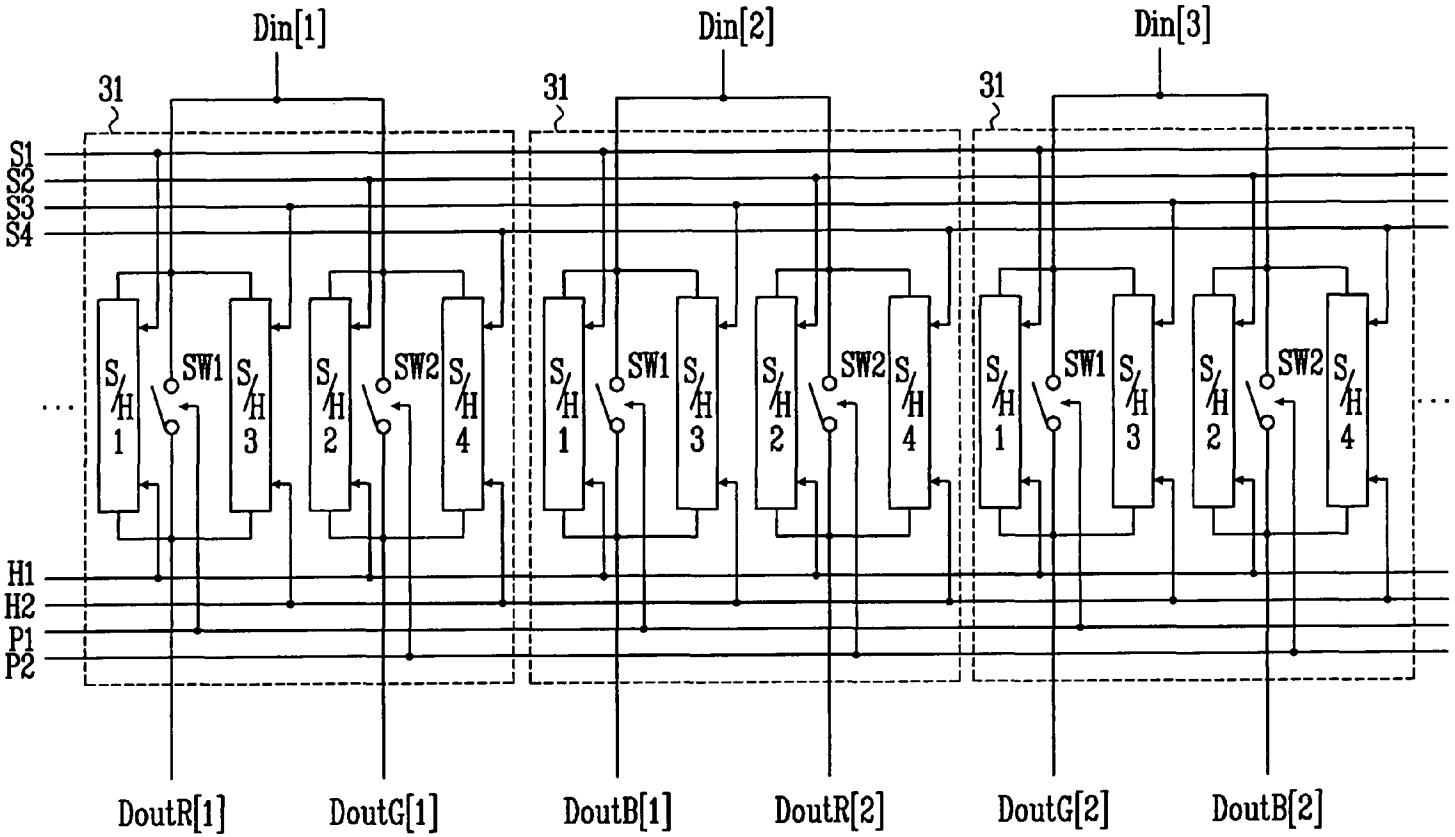
FIG. 6 is a circuit diagram of the first embodiment of the demultiplexer adopted for the organic electroluminescent display in FIG. 3.

FIG. 6 is a circuit diagram illustrating the first example of the demultiplexer adopted to the organic electroluminescent display in FIG. 3.

In FIG. 6, the demultiplexer comprises m demultiplexing circuits 31.

Each demultiplexing circuit 31 is, for example, a 1:2 demultiplexing circuit of sample/hold type. Since this is a 1:2 demultiplexing circuit, the output data current transmitted to one input data line Din is demultiplexed and is transmitted to two output data lines. Two output data lines are connected to groups of sub-pixels of different colors, for example, a group of red and green sub-pixels, a group of blue and red sub-pixels, or a group of green and blue sub-pixels. More specifically, the first red output data line DoutR[1] and the first green output data line DoutG[1] are connected to the first demultiplexing circuit; the first blue output data line DoutB[1] and the second red output data line DoutR[2] are connected to the second demultiplexing circuit; the second green output data line DoutG[2] and the second blue output data line DoutB[2] are connected to the third demultiplexing circuit. Before the output data are applied to each output data line, a pre-charge voltage is demultiplexed for each output data line and applied.

Each demultiplexing circuit 31 includes a first sample/hold circuit through a fourth sample/hold circuit, S/H1 through S/H4, a first pre-charge switch SW1 and a second pre-charge switch SW2. Each demultiplexing circuit 31 is connected to: first through fourth sample lines, S1 through S4; first and second hold lines, H1 and H2; and first and the second pre-charge signal lines, P1 and P2.

Here, the first sample/hold circuit S/H1 records the voltage corresponding to the output data current transmitted to the input data line Din to a capacitor (not shown) in response to the first sample signal applied to the first sample line S1, and afterwards, transmits current corresponding to the voltage of the capacitor to the output data line Dout in response to the first hold signal applied to the first hold line H1.

The second sample/hold circuit S/H2 records the voltage corresponding to the output data current transmitted to the input data line Din to a capacitor (not shown) in response to the second to sample signal applied to the second sample line S2, and afterwards, transmits the current corresponding to the voltage of the capacitor to the output data line Dout in response to the first hold signal applied to the first hold line H1.

The third sample/hold circuit S/H3 records the voltage corresponding to the output data current transmitted to the input data line Din to a capacitor (not shown) in response to the third sample signal applied to the third sample line S3, and afterwards, transmits the current corresponding to the voltage of the capacitor to the output data line Dout in response to the second hold signal applied to the second hold line H2.

The fourth sample/hold circuit S/H4 records the voltage corresponding to the output data current transmitted to the input data line Din to a capacitor (not shown) in response to the fourth sample signal applied to the fourth sample line S4, and afterwards, transmits the current corresponding to the voltage of the capacitor to the output data line Dout in response to the second hold signal applied to the first hold line H2.

The first pre-charge switch SW1 is connected to both the input and output terminals of the first and the third sample/hold circuits S/H1 and S/H3 and transmits a pre-charge voltage corresponding to the output data current, transmitted to input data line Din, to the output data line Dout in response to the pre-charge signals applied to the first pre-charge signal line P1.

The second pre-charge switch SW2 is connected to both the input and output terminals of the second and the fourth sample/hold circuits, S/H2 and S/H4, and transmits the pre-charge voltage corresponding to the output data current, transmitted to input data line Din, to the output data line Dout in response to the pre-charge signal applied to the second pre-charge signal line P2.

Meanwhile, the pre-charge voltage applied to the input data line Din may have voltage levels of various methods such as the following: first, the pre-charge voltage can be set to the voltage level that has the optimal data programming speed corresponding to the output data current that is transmitted to the output data line Dout that is connected to the pre-charge switch. More specifically, before the output data current of the given gradation level is transmitted to the first red output data line DoutR[1], the pre-charge voltage that is set to the voltage level that has the optimal data programming speed corresponding to the red gradation level is applied to the first red output data line DoutR[1]. Also, before the output data current of the given gradation level is transmitted to the first green output data line DoutG[1], the pre-charge voltage that is set to the voltage level that has the optimal data programming speed corresponding to the green gradation level is applied to the first green output data line DoutR[1]; second, the pre-charge voltage can be divided into two cases, where in one case, the gradation level of the output data current transmitted to the output data line Dout connected to the pre-charge switch is 0 (black), and where in the other case, it is different from the first case. More specifically, the output data current that related to 0 (black) gradation level, or before the gradation level transmits the output data current that is close to 0 (black) to the output data line, the pre-charge voltage set to a high-voltage level corresponding to gradation level 0 is applied to the output data line. And before the output data current corresponding to gradation level except for the given gradation level is transmitted to the output data line, the pre-charge voltage that is set to the given voltage level is applied to the output data line. The said given voltage level can be a voltage level that all of output data currents transmitted to the output data line Dout meet the given data programming time. Also, the given voltage level may be the voltage level that output data current corresponding to gradation level 0 among all of output data currents transmitted to the output data line Dout, or output data current except for the output data current close to the gradation level 0 meets the data programming time.

With this configuration, since the demultiplexer shown in FIG. 6 can transmit the pre-charge voltage to the output data line Dout before it transmits the data current to the output data line Dout, the time it takes to fully drain (discharge) the parasitic capacitor connected to the output data line Dout can be reduced. Accordingly, time required for performing data programming to the pixels connected to the output data line can be reduced.

Figure 7:
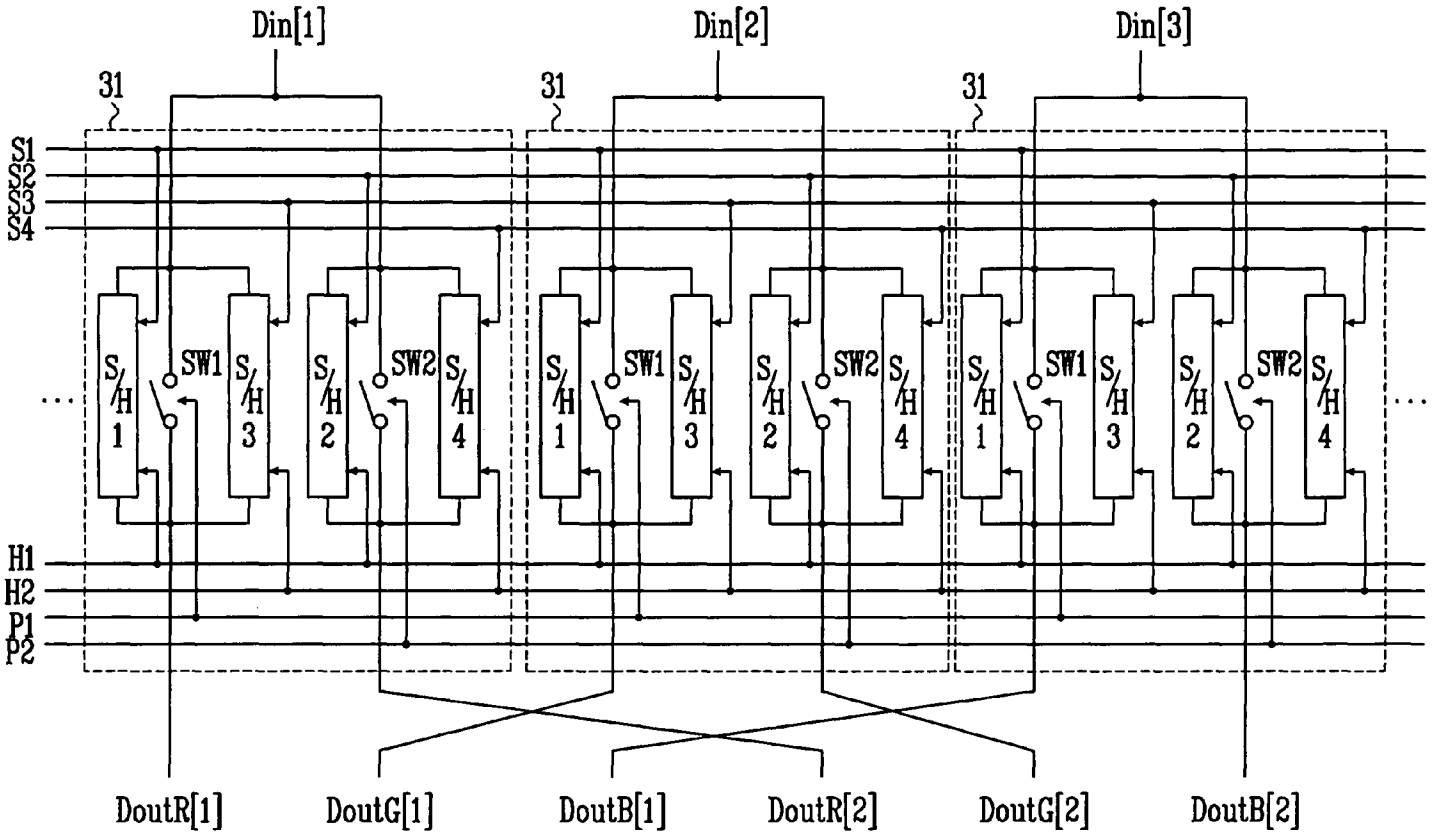
FIG. 7 is a circuit diagram of the second embodiment of the demultiplexer adopted for the organic electroluminescent display in FIG. 3.

FIG. 7 is a circuit diagram that shows the second example of a demultiplexer adopted to the organic electroluminescent display in FIG. 3.

In FIG. 7, the demultiplexer has m demultiplexing circuits 31.

Each demultiplexing circuit 31 is, for example, a 1:2 demultiplexing circuit of the sample/hold type. Since it is a 1:2 demultiplexing circuit, the input data current transmitted to one input data line Din is demultiplexed and is transmitted to two output data lines. FIG. 7 shows a demultiplexer, as opposed to a demultiplexer in FIG. 6, with two output data lines connected to a group of sub-pixels having the same color, for example, in this case, the two output data lines are connected to a red sub-pixel group DoutR[1], DoutR[2], a green sub-pixel group DoutG[1], DoutG[2], and a blue sub-pixel group DoutB[1], DoutB[2]. More specifically, the first red output data line DoutR[1] and the second red output data line DoutR[2] are connected to the first demultiplexing circuit; the first green output data line DoutG[1] and the second green output data line DoutG[2] are connected to the second demultiplexing circuit; and the first blue output data line DoutB[1] and the second blue output data line DoutB[2] are connected to the third demultiplexing circuit.

Figure 8:
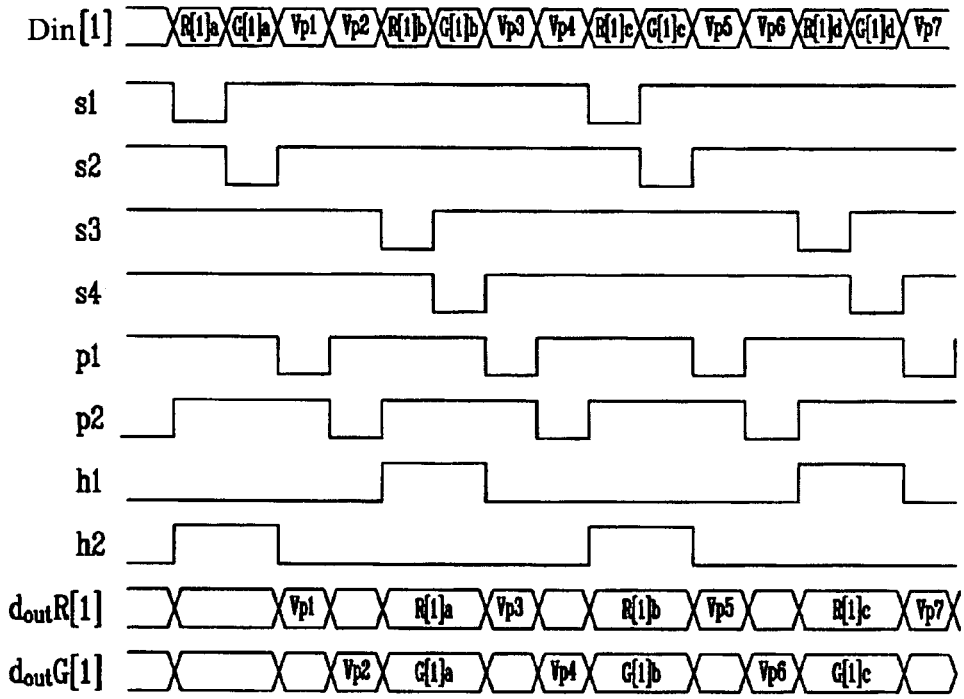
FIG. 8 is a signal diagram of input and output signals of the demultiplexer in FIG. 6 shown as time elapsed.

FIG. 8 is a signal diagram showing the input-output signals of a demultiplexing circuit in FIG. 6 as time passes.

FIG. 8 illustrates, input data din[1], a first sample signal s1 through a fourth sample signal s4, a first hold signal h1, a second hold signal h2, a first pre-charge signal p1, a second pre-charge signal p2, red output data DoutR[1] and green output data DoutG[1].

The signal diagram in FIG. 8 is based on the assumption that the sample/hold circuit in FIG. 6 samples current transmitted to the input data line in response to a low sample signal and transmits current, corresponding to a sampled current value, to the output data line in response to a high hold signal.

Referring to FIGS. 6 and 8, to explain actions of the demultiplexer, when the first sample signal s1 is low, a current value R[1]a of the input data Din[1] is sampled and stored in the first sample/hold circuit S/H1. And when the second sample signal s2 is low, a current value G[1]a of the input data Din[1] is sampled and stored in the second sample/hold circuit S/H2. Meanwhile, since the first pre-charge signal p1 and the second pre-charge signal p2 are high, the first pre-charge switch SW1 and the second pre-charge switch SW2 are off.

Next, when the first pre-charge signal p1 is low, the first pre-charge switch SW1 is on and applies a pre-charge voltage Vp1 corresponding to the current value R[1]a of the input data Din[1] to the output data line DoutR[1]. When the second pre-charge p2 is low, the second pre-charge switch SW2 is on and applies a pre-charge voltage Vp2 corresponding to the current value G[1]a of the input data Din[1] to the output data line DoutG[1]. At the moment, different pre-charge voltages Vp1 and Vp2 are applied to the red output data line DoutR[1] and the green output data line DoutG[1].

Next, when the third sample signal s3 is low, a current value R[1]b of the input data Din[1] is sampled and stored in the third sample/hold circuit S/H3, and when the fourth sample signal s4 is low, a current value G[1]b of the input data Din[1] is sampled and stored in the fourth sample/hold circuit S/H4. Meanwhile, since the first hold signal h1 is high, the first sample/hold circuit S/H1 and the second sample/hold circuit S/H2, that receive input of the first hold signal h1, supply current related to the current values R[1]a and G[1]b, that were previously sampled and stored, to the output data lines DoutR[1] and DoutG[1]. Meanwhile, since the first pre-charge signal p1 and the second pre-charge signal p2 are high, the first pre-charge switch SW1 and the second pre-charge switch SW2 are off.

Next, when the first pre-charge signal p1 is low again, the first pre-charge switch SW1 is on and applies a pre-charge voltage Vp3 corresponding to the current value R[1]b of the input data Din[1] to the output data line DoutR[1]. When the second pre-charge p2 is low again, the second pre-charge switch SW2 is on and applies a pre-charge voltage Vp4 corresponding to the current value G[1]b of the input data Din[1] to the output data line DoutG[1]. At the moment, different pre-charge voltages Vp3 and Vp4 are applied to the red output data line DoutR[1] and the green output data line DoutG[1], respectively.

Then, when the first sample signal s1 is low again, a current value R[1]c of the input data Din[1] is sampled and stored in the first sample/hold circuit S/H1, and when the second sample signal s2 is low again, a current value G[1]c of the input data Din[1] is sampled and stored in the second sample/hold circuit S/H2. During this time, the second hold signal h2 is high so the third and fourth sample/hold circuit S/H3 and S/H4, that previously received and stored input current values R[1]b and G[1]b, output the current values R[1]b and G[1]b to the red output data line DoutR[1] and the green output data line DoutG[1], respectively. Meanwhile, since the first pre-charge signal p1 and the second pre-charge signal p2 are high, the first pre-charge switch SW1 and the second pre-charge switch SW2 are off.

Next, when the first pre-charge signal p1 is again low, the first pre-charge switch SW1 is on and applies the pre-charge voltage Vp5 corresponding to the current value R[1]c of the input data Din[1] to the output data line DoutR[1]. When the second pre-charge p2 is again low, the second pre-charge switch SW2 is on and applies the pre-charge voltage Vp6 corresponding to the current value G[1]c of the input data Din[1] to the output data line DoutG[1]. At the moment, pre-charge voltages different from each other, and Vp5 and Vp6 are applied to the red output data line DoutR[1] and the green output data line DoutG[1].

Then, when the first sample signal s3 is yet again low, a current value R[1]d of the input data Din[1] is sampled and stored in the third sample/hold circuit S/H3, and when the fourth sample signal s4 is low, a current value G[1]d of the input data Din[1] is sampled and stored in the fourth sample/hold circuit S/H4. Meanwhile, since the first hold signal h1 is high, the first and the second sample/hold circuits S/H1 and S/H4, which previous sampled and stored current values R1[c] and G1[c], output the sampled current values R[1]c and G[1]c to the output data lines DoutR[1] and DoutG[1].

In this way, before the demultiplexing circuit of the sample/hold type demultiplexes the input data current inputted through the input data line Din[1] and then transmits to the output data lines DoutR[1] and DoutG[1], it first demultiplexes the pre-charge voltage inputted through the input data line Din[1] on each output data line DoutR[1] and DoutG[1] separately and transmits each to the respective output data line, DoutR[1] and DoutG[1]. At this time, each pre-charge voltage gets value corresponding to the output data current.

Meanwhile, by applying the same signal as shown in FIG. 8, the demultiplexer as shown in FIG. 7 demultiplexes the pre-charge voltage value of different values according to the input data current Din[1] and applies it to each of the first and second red output data lines DoutR[1] and DoutR[2]; according to the input data current Din[2], the demultiplexer demultiplexes different pre-charge voltages and applies it to each of the first and second green output data lines DoutG[1] and DoutG[2]; and according to the input data current Din[3], the demultiplexer demultiplexes different pre-charge voltage values and applies it to each of the first and second blue output data lines, DoutB[1] and DoutB[2].

At this time, the pre-charge voltage applied to the input data line can get voltage levels by various methods as the following: first, the pre-charge voltage can be set to the voltage level that has the optimal data programming speed by corresponding to the output data current transmitted to the output data line Dout connected to the pre-charge switch. Second, the pre-charge voltage can be divided into the case where the gradation level of the output data current transmitted to the output data line Dout connected to the pre-charge switch is 0 (black) and the case with the exception to the previous case. For example, the pre-charge voltage is set as a high voltage level corresponding to a gradation level of 0 and then previously applied to the output data line before the output data current having or approximating to a gradation level of 0 (black) flows in the output data line. Further, the pre-charge voltage is set as a predetermined voltage level and then previously applied to the output data line before the output data current corresponding to the other gradation level (not black) flows in the output data line, wherein the predetermined voltage level is determined as a voltage level allowing all output data currents transmitted to the output data line Dout to satisfy a predetermined data programming time. Alternatively, the predetermined voltage level may be determined as a voltage level allowing all other output data currents but the output data current having or approximating to the gradation level of 0 (black) to satisfy the predetermined data programming time.

Figure 9:
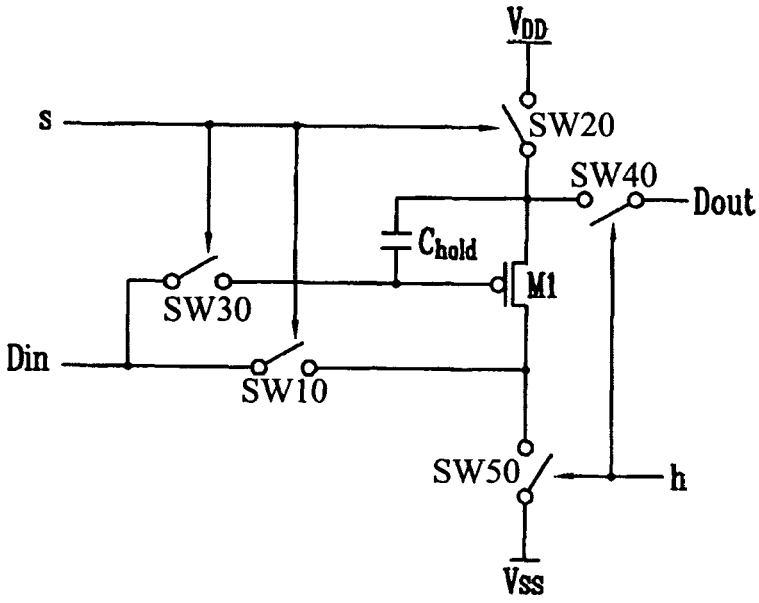
FIG. 9 is a plan view of a sample/hold circuit adopted for the demultiplexer of the present invention.

FIG. 9 illustrates a sample/hold circuit adopted to the embodiment of the present invention.

Referring to the FIG. 9, the sample/hold circuit includes first to the fifth switches SW10, SW20, SW30, SW50 AND SW50, a first transistor M1 and a storage capacitor Chold.

The first switch SW10 connects the input data line Din to the drain of the first transistor M1, in response to a sample signal s. The second switch SW20 connects a high-voltage $V_{DD}$ line to the source of the first transistor M1 to and to a first terminal of the storage capacitor Chold, in response to the sample signal s. The third switch SW30 connects the input data line Din to the gate of the first transistor M1 to and to a second terminal of the storage capacitor Chold, in response to the sample signal s. The fourth switch SW40 connects the output data line Dout to the source of the first transistor M1 in response to a hold signal h. The fifth switch SW5 connects the drain of the first transistor to a low-voltage Vss line in response to the hold signal h.

During the sampling period when the sample signal s is given to turn on the first to third switches SW10, SW20, SW30 and the hold signal h is given to turn off the fourth and fifth switches SW40, SW5, the current path is formed from the high voltage line VDD to the input data line Din via the first transistor M1, so that the input data current IDin is transmitted from the input data line Din to the first transistor M1. Thus, the voltage corresponding to the current flowing through the first transistor M1 is stored in the storage capacitor Chold.

Then, during the hold period when the sample signal s is given to turn off the first to third switches SW10, SW20, SW30 and the hold signal h is given to turn on the fourth and fifth switches SW40, SW5, the current path is formed from the output data line Dout to the low-voltage line Vss via the first transistor M1, so that the current corresponding to the voltage stored in the storage capacitor Chold, i.e., the current equal to the input data current IDin is transmitted to the output data line Dout.

Consequently, the sample/hold circuit stores the voltage corresponding to the input data current IDin in the storage capacitor Chold in response to the sample signal s, and transmits the current corresponding to the voltage stored in the storage capacitor Chold to the output data line Dout in response to the hold signal h. Preferably, the data driver has a current-sink type output terminal, that is, the current is introduced from the outside into the data driver through the output terminal of the data driver. The reason why is because the current-sink type output terminal is preferable so that the data driver having the current-sink type output terminal can reduce variation of the output current, reduce the voltage level of the power supply, reduce the size of the chip by using a low-voltage element, and reduce the price of the chip for the data driver. Therefore, the sample/hold circuit of FIG. 9 includes a current-source type input terminal suitable for the data driver having the current-sink type output terminal. In other words, the current flows through the input terminal of the sample/hold circuit to the outside.

In the foregoing embodiment, the demultiplexer comprises the 1:2 demultiplexing circuit of the sample/hold method, but not limited thereto and may comprises an 1:3 demultiplexing circuit, an 1:4 demultiplexing circuit, and so on.

Also, the sub-pixels, to which the output data line is connected, comprise the red sub-pixel, the green sub-pixel and the blue sub-pixel. However, the sub-pixels may comprise a red sub-pixel, a green sub-pixel, a blue sub-pixel and a white sub-pixel.

As described above, the present invention provides an organic electroluminescent display and a demultiplexer, in which a data driver has a simple structure, and a pre-charge voltage of plural levels corresponding to output data is demultiplexed and transmitted to a data line before programming data, thereby reducing a data programming time.

Further, the present invention provides an organic electroluminescent display and a demultiplexer, in which a current programmable pixel is driven by a voltage pre-charging method, thereby decreasing the intensity of data current and reducing power consumption.

Although a few embodiments of the present invention have been shown and described, it would be appreciated by those skilled in the art that changes might be made in this embodiment without departing from the principles and spirit of the invention, the scope of which is defined in the claims and their equivalents.

What is claimed is:

1. An organic electroluminescent display, comprising:

a plurality of pixels including a plurality of sub-pixels and displaying images corresponding to a first data current;

a plurality of scan lines transmitting a scan signal to the plurality of pixels;

a plurality of first data lines transmitting the first data current to the plurality of pixels;

a scan driver outputting the scan signal to the plurality of scan lines;

a demultiplexer comprising a plurality of demultiplexing circuits; and a data driver outputting a second data current to a plurality of second data lines, wherein the demultiplexing circuit transmits the first data current, obtained by demultiplexing the second data current transmitted to one second data line in a sample/hold method, to the first data lines, wherein a pre-charge voltage corresponding to the second data current of each second data line is previously transmitted to the first data line before the first data current is transmitted to the first data lines.

2. The organic electroluminescent display according to claim 1, wherein the demultiplexing circuit comprises:

a plurality of sample/hold circuits, each of which samples and holds the second data current in response to a sample signal, and transmits a current corresponding to the held sampled second data current to the first data line in response to a hold signal; and a plurality of pre-charge switches, each of which applies the pre-charge voltage to the first data line in response to a corresponding pre-charge signal.

3. The organic electroluminescent display according to claim 2, wherein the plurality of sample/hold circuits are divided into a first group sample/hold circuit and a second group sample/hold circuit, and the second group sample/hold circuit outputs the first data current corresponding to a previously sampled and held second data current while the first group sample/hold circuit sequentially samples and holds the second data current, and the first group sample/hold circuit outputs the first data current corresponding to the previously sampled and held second data current while the second group of sample/hold circuit sequentially samples and holds the second data current.

4. The organic electroluminescent display according to claim 3, wherein the sample/hold circuit comprises:

a first transistor;

a storage capacitor comprising a first terminal connected to a source of the first transistor and a second terminal connected to a gate of the first transistor;

a first switch connecting the second data line with a drain of the first transistor in response to the sample signal;

a second switch connecting the source of the first transistor with a high voltage line in response to the sample signal;

a third switch connecting the second data line with the second terminal of the storage capacitor in response to the sample signal;

a fourth switch connecting the first data line with the source of the first transistor in response to the hold signal; and a fifth switch connecting the drain of the first transistor with a low voltage line in response to the hold signal.

5. The organic electroluminescent display according to claim 4, wherein the sample signal and the hold signal are periodic signals, and one cycle period includes a sample period and a hold period, the sample signal is set to allow the first through third switches to be turned on during the sample period and turned off during the hold period, and the hold signal is set to allow the fourth and fifth switches to be turned on during the hold period and turned off during the sample period.

6. The organic electroluminescent display according to claim 2, wherein each pre-charge switch transmits the pre-charge voltage corresponding to the second data current to the first data line before the first data current is transmitted to the first data line connected thereto.

7. The organic electroluminescent display according to claim 2, wherein each pre-charge switch selects one of the pre-charge voltages set either to high voltage level and a predetermined voltage level and transmits the selected one to the first data line before the first data current is transmitted to the first data line connected thereto.

8. The organic electroluminescent display according to claim 7, wherein the pre-charge voltage having the high voltage level is selected and transmitted to the first data line in the case where the first data current has a gradation level of 0 (black), and the pre-charge voltage having the predetermined voltage level is selected and transmitted to the first data line in the case where the first data current has a gradation level of not 0 (black).

9. The organic electroluminescent display according to claim 2, wherein the pre-charge switch of the demultiplexer is turned off while the plurality of sample/hold circuits of the demultiplexing circuit performs a sample and hold operation and while the current corresponding to the sampled and held second data current is transmitted to the first data line, and the pre-charge switch of the demultiplexer is turned on in response to the pre-charge signal before the current corresponding to the sampled and second data current is transmitted to the first data line.

10. The organic electroluminescent display according to claim 1, wherein the first data lines connected to the demultiplexing circuit are connected to the sub-pixels different in colors from each other.

11. The electroluminescent display according to claim 1, wherein the first data lines connected to the demultiplexing circuit are connected to the sub-pixels equal in colors to each other.

12. A demultiplexer for an electroluminescent display, said demultiplexer comprising:

a plurality of demultiplexing circuits;

a plurality of sample signal lines transmitting a sample signal to the demultiplexing circuits;

first and second hold signal lines transmitting hold signals to the demultiplexing circuits; and first and second pre-charge signal lines transmitting pre-charge signals to the demultiplexing circuits, wherein each said demultiplexing circuit transmits an output data current, obtained by demultiplexing an input data current transmitted to one input data line in a sample/hold method in response to the sample and hold signals, to a plurality of output data lines, wherein a pre-charge voltage corresponding to the input data current of the one input data line is previously transmitted to the plurality of output data lines before the output data current is transmitted to the plurality of output data lines.

13. The demultiplexer according to claim 12, wherein the demultiplexing circuit comprises:

first and second group sample/hold circuits, each circuit of which samples the input data current, and transmits the output data current corresponding to the sampled input data current to corresponding output data lines; and a plurality of pre-charge switches, each of which applies a pre-charge voltage corresponding to the input data current to the output data lines.

14. The demultiplexer according to claim 13, wherein each of said sample/hold circuits comprises:

a first transistor;

a storage capacitor comprising a first terminal connected to a source of the first transistor and a second terminal connected to a gate of the first transistor;

a first switch connecting the input data line with a drain of the first transistor in response to the sample signal;

a second switch connecting the source of the first transistor with a high voltage line in response to the sample signal;

a third switch connecting the input data line with the second terminal of the storage capacitor in response to the sample signal;

a fourth switch connecting the output data line with the source of the first transistor in response to the hold signal; and a fifth switch connecting the drain of the first transistor with a low voltage line in response to the hold signal.

15. The organic electroluminescent display according to claim 14, wherein the sample signal and the hold signal are periodic signals, and one cycle period includes a sample period and a hold period, the sample signal is set to allow the first through third switches to be turned on during the sample period and turned off during the hold period, and the hold signal is set allow the fourth and fifth switches to be turned on during the hold period and turned off during the sample period.

16. The demultiplexer according to claim 13, wherein the plurality of pre-charge switches comprises a first pre-charge switch and a second pre-charge switch, and the first pre-charge switch applies the pre-charge voltage corresponding to the input data current from the input data line to a first output data line in response to the first pre-charge signal, and the second pre-charge switch applies the pre-charge voltage corresponding to the input data current from the input data line to a second output data line in response to the second pre-charge signal.

17. The demultiplexer according to claim 16, wherein each of the pre-charge switches of the demultiplexer is turned off while the plurality of sample/hold circuits of the demultiplexing circuit performs a sample and hold operation on the input data current and while the current corresponding to the sampled and held input data current is transmitted to the output data line, and the first and second pre-charge switches are turned on in response to the first and second pre-charge signals, respectively, before the current corresponding to the sampled and held input data current is transmitted to the output data line.

18. The demultiplexer according to claim 13, wherein each said pre-charge switch transmits the pre-charge voltage corresponding to the input data current to the output data line before the output data current is transmitted to the output data line connected thereto.

19. The demultiplexer according to claim 13, wherein each said pre-charge switch selects one of the pre-charge voltages set either to high voltage level and a predetermined voltage level and transmits the selected one to the output data line before the output data current is transmitted to the output data line connected thereto.

20. The demultiplexer according to claim 19, wherein the pre-charge voltage having the high voltage level is selected and transmitted to the output data line in the case where the output data current has a gradation level of 0 (black), and the pre-charge voltage having the predetermined voltage level is selected and transmitted to the output data line in the case where the output data current has a gradation level of not 0 (black).

* * * * *